United States Patent [19]

Schwörer

[11] 4,301,990

[45] Nov. 24, 1981

[54] FORMWORK PANEL FOR CONCRETE WALLS WITH WEDGE-TYPE CONNECTIONS

[75] Inventor: Artur Schwörer, Senden, Fed. Rep. of Germany

[73] Assignee: Peri-Werk Artur Schwörer KG, Weissenhorn, Fed. Rep. of Germany

[21] Appl. No.: 125,269

[22] Filed: Feb. 27, 1980

[30] Foreign Application Priority Data

Mar. 3, 1979 [DE] Fed. Rep. of Germany ..... 2908339
Jun. 20, 1979 [DE] Fed. Rep. of Germany ..... 2924777

[51] Int. Cl.[3] ..... E04G 11/06; E04G 17/04

[52] U.S. Cl. ..... 249/44; 249/47; 249/192; 249/210; 249/219 R; 249/219 W; 403/314; 403/398

[58] Field of Search ..... 403/374, 409, 393, 314, 403/398, 399; 249/18, 19, 23–25, 38, 44–47, 205, 219 R, 219 W, 192, 207, 210; 24/69 TS, 130, 264, 268

[56] References Cited

U.S. PATENT DOCUMENTS

| | | | |
|---|---|---|---|
| 1,300,435 | 4/1919 | McKay | 249/192 |
| 2,017,626 | 10/1935 | Köhnke | 403/398 |
| 2,461,733 | 2/1949 | Harder | 249/45 |
| 2,554,430 | 5/1951 | Vines | 249/210 |
| 3,315,938 | 4/1967 | Gates | 249/46 |
| 3,482,813 | 12/1969 | Wells et al. | 249/46 |
| 4,123,032 | 10/1978 | Teschner | 249/18 |

FOREIGN PATENT DOCUMENTS

| | | | |
|---|---|---|---|
| 2049245 | 4/1972 | Fed. Rep. of Germany | 249/46 |
| 2757450 | 6/1979 | Fed. Rep. of Germany . | |
| 433918 | 4/1948 | Italy | 249/46 |

OTHER PUBLICATIONS

Anon., Steidle-Supra-Rahmenschalung Publication.

*Primary Examiner*—Willard E. Hoag

[57] ABSTRACT

In a formwork panel for concrete walls having a forming skin carried on a steel frame comprising frame pieces extending along the edges of the said forming skin and at least one wedge slide guided on a cross-strut of the said frame, which wedge slide serves to press one end of a bar extending over the joint between two neighboring formwork panels against frame pieces of the said formwork panel, the slide (20) is guided on a cross-strut (5) and has an essentially U-shaped cross-section the legs (22) of which are provided with inwardly extending projections (24) which coact with projections (15) extending laterally from the cross-strut (5) to form a wedge-type connection. The height of the cross-strut (5) is reduced as compared to that of the frame pieces (4) by the value corresponding to the thickness of the cross bar (30) of the slide (20). The slide (20) can be moved into a position in which it does not project during transportation of the panels beyond the surface of the frame opposite the forming plane, and the wedge-type connection is very sturdy. (FIG. 3).

15 Claims, 3 Drawing Figures

FORMWORK PANEL FOR CONCRETE WALLS WITH WEDGE-TYPE CONNECTIONS

The invention relates to a formwork panel having a forming skin carried by a steel frame comprising frame pieces extending along the edges of the said forming skin and cross-struts connecting such frame pieces, the frame being provided with wedge-type connections comprising a bar extending over the joint between two neighbouring formwork panels and having its two ends pressed by wedge slides against frame pieces of neighbouring formwork panels for fastening and aligning the latter, the wedge slide being mounted on the frame in a manner such that it can be moved into a position in which it does not project during transportation of the formwork panels beyond the face of the frame opposite the forming plane. In a known formwork panel as disclosed by the firm Steidle GmbH & Co. in a prospectus and later embodied in German Laid-Open patent application No. 27 57 450.1, dated June 28, 1979, the frame comprises a special truss portion welded to a frame piece in parallel relationship to the connecting bar and in parallel and spaced relationship to a cross-strut and projecting inwardly from the said frame piece in the plane of the frame. The end of the said truss portion is free. The truss portion serves to guide the wedge slide so that the latter can be tilted at the free end of the said truss over the edge of the free face of the truss, about an axis extending vertically to the travelling direction, so that the slide no longer projects beyond the face of the frame opposite the forming plane. This is desirable in order to permit easy stacking of the formwork panels during transportation to the site.

However, this known formwork panel has the disadvantage that a separate truss with one free face must be welded into the frame as support for the wedge-type connection and that the stability of this truss section which has only one end fastened to the frame piece is not particularly high so that the bar connecting two neighbouring formwork panels which is held against these truss sections by means of the wedge slide cannot transfer very high bending couples to the formwork panels so that often the mere tightening of the wedge-type connections will not suffice to bring the formwork panels into the forming plane with the required exactitude. For greater stability, the truss sections should be fastened to the frame as closely as possible to a cross-strut. However, in this case only one face of the wedge slide at its end facing away from the forming plane can be used for hammering when tightening the wedge slide, because a hammering surface provided between the truss section and the cross-strut is hardly accessible because of the small space remaining between the truss and the cross-strut. Finally, the wedge slide of the known formwork panel takes the form of a closed four-walled body with the connecting rod and the truss section, too, located within its interior cross-section. As a result, the truss section of the known formwork panel consists only of a flat bar comprising the wedge surface and having its end bent over to project inwardly, and that again has an unfavourable effect on the stability of the wedge-type connection.

Now, it is the object of the present invention to eliminate the disadvantages of the known formwork panel. This problem is solved in that the wedge slide is guided on a cross-strut in the area of the wedge connection. The wedge slide has the shape of a U, the legs of which are provided with inwardly extending projections coacting in operative relationship, to secure the adjacent panels, with parts laterally extending from the cross-strut to form a wedge-type connection and in an inoperative position closely held on the cross-strut. The height of the cross-strut is reduced in relation to that of the remaining frame by a value corresponding to the thickness of the cross bar of the slide, so that in the inoperative position the wedge slide does not extend beyond the rear plane of the panel.

This embodiment of the invention offers the advantage that the wedge-type connection is formed with the aid of a cross-strut of the frame which has a stability essentially higher than the truss section of the known formwork panel which truss section has only one end secured by welding. As a result this wedge-type connection can transfer essentially higher bending couples so that neighbouring formwork panels can be forced into the common forming plane, simply by tightening this wedge-type connection. Inspite of that, however, the formwork panel of the invention also offers the advantage that during transportion of the formwork panels the wedge slide can be moved into a position in which it does not project beyond the face of the frame opposite the forming plane, as the height of the cross-strut is reduced in relation to that of the frame pieces by a value corresponding to the thickness of the cross bar of the slide. Also, this arrangement of the wedge-type connection, i.e. directly on the cross-strut, makes it possible to provide surfaces against which 2 hammer can be applied when tightening the slide not only in the area of the cross bar of the wedge slide, but also at its side faces, i.e. in the immediate vicinity of the wedge surfaces. Due to the fact that the wedge slide is slidably guided on a cross-strut the wedge slide can be easily prevented from falling off the formwork panel in the transport position.

In one embodiment of the invention the parts projecting over one side of the cross-strut are provided on a plate mounted on the face of the cross-strut opposite the forming plane, and the slide can be moved along the cross-strut until it gets out of engagement with the projections of the cross-strut forming part of the wedge-type connection.

In this arrangement, either the parts laterally projecting over the cross-strut or else the projections extending inwardly from the ends of the leg of the wedge slide, or both parts can form the wedge surfaces.

In another embodiment of the invention projections are provided on the side walls of the cross-strut extending at a right angle in relation to the forming plane, which projections coact with projections provided at the inner face of the legs of the wedge slide to retain the latter in a lowered position e.g., with regard to the rear face of the panel, into which the slide can be moved after it has been displaced out of engagement with the projections of the cross-strut forming part of the wedge-type connection and in which it is lowered far enough to ensure that it does no longer project beyond the face of the frame opposite the forming plane so that the back of the frame forms a level supporting surface for another formwork panel deposited thereon for transportation purposes.

In another embodiment of the invention, the side walls of the cross-strut may be provided with guide faces for guiding the wedge slide from its raised position into its lowered position and for retaining it there by wedge action.

In another embodiment of the invention means are provided which, for the purpose of introducing the connecting bar of neighbouring formwork panels into the wedge slide, retain the latter in a raised position in relation to its lowered position, in which the clear height of the wedge slide exceeds the height of the bar cross-section. This offers the advantage to make the introduction of the connecting bar extremely simple. If no such means are provided, the wedge slide, which can be displaced by its clear height, does not remain in the raised position because the connecting bar is introduced with the formwork panel in the vertical position in which the wedge slide due to its mobility tends to tilt downwardly into an inclined position so that it will be necessary during the introduction of the bar to retain the wedge slide by hand in its raised position. This necessity is eliminated by the embodiment of the invention just described. The means for retaining the wedge slide in its raised position may consist for instance of projections which in the raised position of the slide act from below against the surface of the slide, for instance against the face of the leg ends of the wedge slide.

To permit the wedge slide to be exchanged, a clearance is provided in the direction of displacement of the wedge slide between the guides guiding the wedge slide in the downward direction and the wedge surfaces fastened at the cross-strut. In the area of this clearance, the slide can be withdrawn from the guides provided at the cross-strut. A removable plate extending laterally beyond the cross-strut serves to partially close this clearance so that with the plate in position the slide cannot be removed from the cross-strut. The plate extends beyond the lateral faces of the cross-strut the same distance as the projections fastened at the cross-strut and forming part of the wedge-type connection.

In one embodiment of the invention both sides of the wedge slide are provided with a rib extending at a right angle in relation to the forming plane. These ribs can be used as impact surfaces for the hammer when tightening the wedge slide.

In another embodiment of the invention, the inclination of the wedge surface of the wedge-type connection perpendicular to the wedge angle is such that the legs of the slide are drawn inwardly when the wedge-type connection is being tightened.

The fact that the legs of the wedge slide are drawn inwardly and, thus, towards the lateral faces of the strut when the wedge-type connection is being tightened, acts to work against the tendency of the legs to deflect outwardly due to the tension forces encountered. As a result, higher wedge forces can be produced as compared to an embodiment not provided with wedge surfaces exhibiting the inclination provided by the invention, provided the same material thickness, or else the same wedge forces can be produced by a slide of smaller dimensions, in particular in the area of its cross bar. The stability of the arrangement is essentially enhanced by the invention.

Although the invention can be used with great advantage in connection with the framework panel described above, it may also be advantageously employed in all cases where the wedge slides of the type described above are used for fastening bars spanning the joint between two neighbouring formwork panels.

The inclination of the wedge surface which causes the legs of the wedge slide to be drawn in the direction of the plane of symmetry of the slide, may be relatively small. In one embodiment of the invention, it is approximately 10°.

The inclination of the wedge surfaces as provided by the invention can be realized in different embodiments of the wedge-type connection. For example, the wedge-type connection may be provided with projections directed inwardly from the slide legs and coating with laterally or downwardly extending projections on the frame strut. In an embodiment in which the projections of the slide legs coact with projections extending from the bottom of the strut, this bottom surface facing the forming skin is spaced from the opposed surface of the forming skin by a clearance corresponding at least to the possible tensioning travel of the wedge-type connection, and the frame strut has one freely projecting end so that the slide can be inserted upon the strut from its free end, without the need to open out the legs of the slide.

The invention is not limited to embodiments with inwardly directed projections on the legs of the slide. In other embodiments, the legs of the slide may be provided with a groove extending in accordance with the wedge angle and having guided therein a projection extending laterally from the frame strut. In this case, too, at least the wall of the groove against which the projection comes to rest during the tightening process and the adjacent wall of the projection have an inclination perpendicular to the wedge angle which ensures that the legs of the slide are drawn inwardly when the wedge-type connection is being tightened.

The drawing shows one embodiment of the invention.

Figure 1:
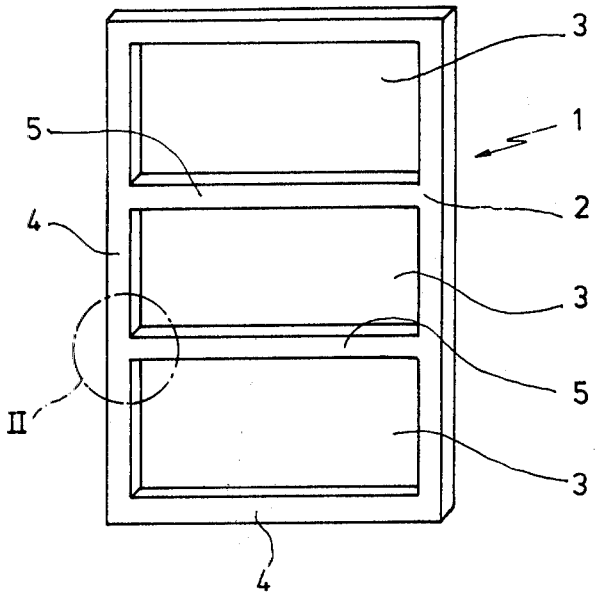
FIG. 1 shows a simplified, reduced representation of a formwork panel without the tensioning device.

A formwork panel 1 comprises a steel frame generally depicted by numeral 2 having a rectangular frame 4 with a head 4*a* extending along the edges of the single-piece forming skin 3, and having cross-struts 5 supporting the forming skin in its middle. In the area of the ends of each cross-strut 5, indicated by the dotted circle, a tensioning device is provided for connecting neighbouring formwork panels.

Figure 4:
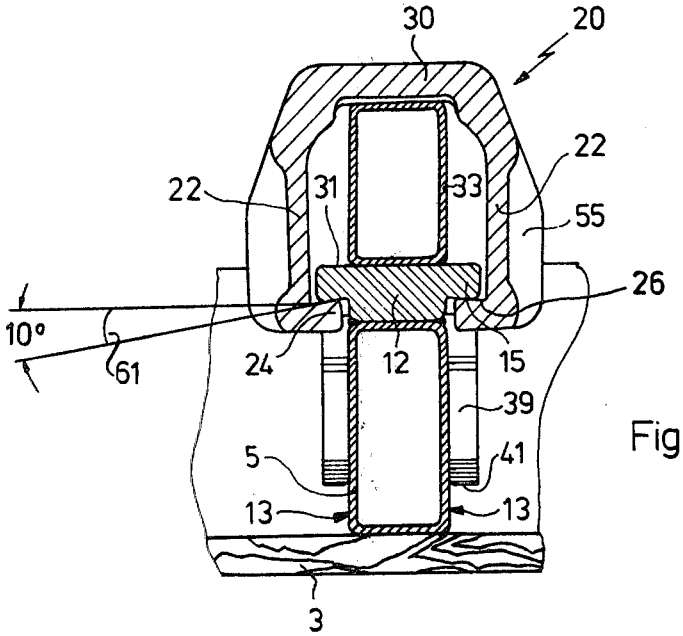
FIG. 4 is a sectional view along line IV—IV in FIG. 3.
Figure 2:
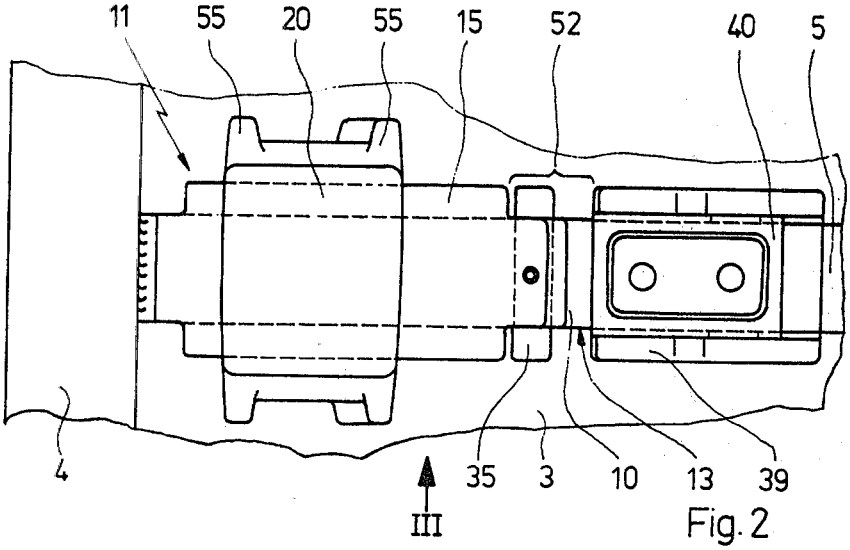
FIG. 2 is a greatly enlarged representation of the tensioning device at the point marked II in the formwork panel shown in FIG. 1, without the connecting bar.
Figure 3:
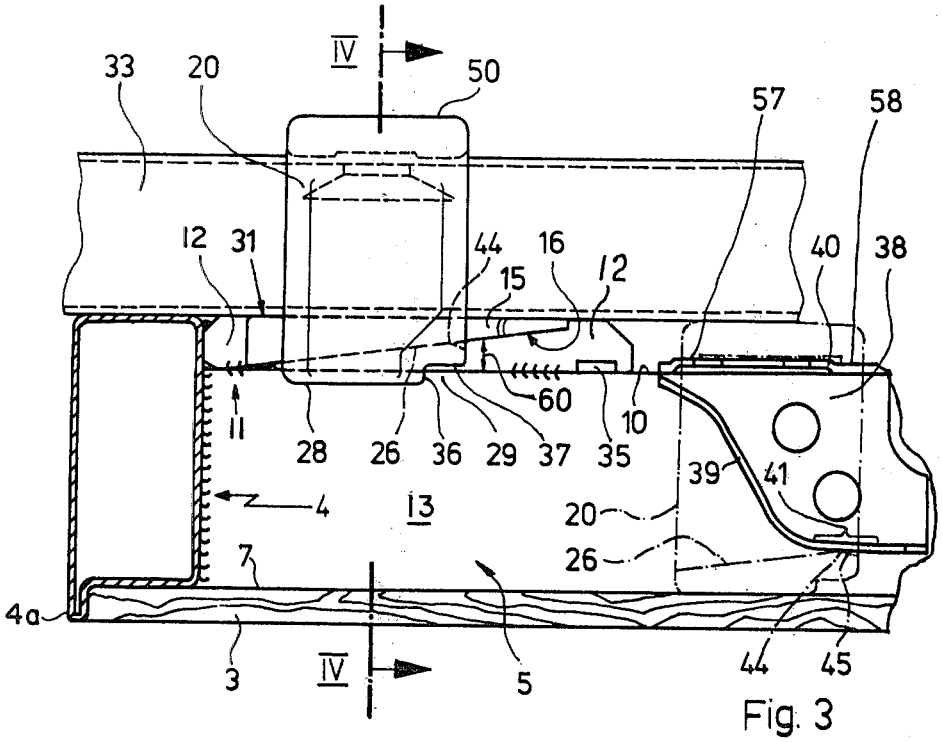
FIG. 3 shows the view indicated by the arrow III in FIG. 2.

As can be seen in FIGS. 2 through 4, the cross-strut 5 has a reduced height as compared to that of the frame piece 4, when measured from the back 7 of the forming skin 3. Welded to the upper face 10 of the cross-strut 5, i.e. to the side opposite the forming skin 3, is a forging, generally depicted by numeral 11 which is also connected by welding to the frame piece 4. The forging 11 comprises a solid rectangular plate 12 having one side resting against the cross-strut 5, and which has the same width as the latter. The plate 12 is provided with projections 15 extending laterally beyond the plane of the side faces 13 of the cross-strut 5. The undersurface 16 of each projection 15 is inclined in the plane of the side faces 13 of the cross-strut 5. The surface 16 of the said projections is inclined in the form of a wedge so that its distance from the forming skin 3 increases with increasing distance from the edge of the formwork panel, as can be seen in FIG. 3. This wedge surface 16 extends over the whole length of the projections 15, and the latter in turn are only little shorter than the greatest length of the plate 12, as can be seen in FIG. 2.

Further, the tensioning device includes a slide 20 which takes the form of a forging of essentially U-shaped configuration. The legs 22 of the slide 20 are provided at their free ends with inwardly extending projections 24. During the tightening operation, the surface 26 of the projections 24 opposite the forming skin 3 coacts with the wedge surfaces 16 of the projections 15 to form the wedge-type connection. The projections 24 extend over almost the whole length of the slide 20 which in the side elevation shown in FIG. 3 can be seen to be of essentially rectangular shape. In its end portion opposite the frame piece 4, the slide 20 is provided with a recess 29.

In order to joint two adjacent panels, a connecting bar 33 which in the embodiment shown takes the form of a rectangular hollow section is inserted into the clearance delimited by the legs 22 and the cross bar 30 of the slide 20 and the surface 31 of the forging 11 facing away from the forming skin 3. Now, when the slide 20 is moved towards the left—as viewed in FIGS. 2 and 3—during the tightening process, so that the inclined projections 24 cooperate with the lateral projections 16 as seen in FIG. 2, the clearance between the cross bar 30 and the forging 11 is reduced and the connecting bar 33 is simultaneously pressed against the forging 11 and the frame piece 4. Due to the large contact surface, a very sturdy connection is obtained, and the neighbouring formwork panels are aligned in one plane.

The inner end portion of the forging 11, opposite the frame piece 4, is equipped with a projection extending beyond at least one side 13 of the cross-strut. This projection is formed by a flat bar 35 which extends beyond both sides 13 and which can be detached by means of a tool. The flat bar 35 rests against the face 10 of the cross-strut 5, its longitudinal direction extends vertically to the longitudinal direction of the cross-strut 5. As can be seen in FIG. 3, the flat bar 35 is arranged outside the wedge surface 16, viewed in the direction of displacement of the slide 20, but is still so close to it that when the slide 20 is displaced to loosen the wedge-type connection, with the surface 26 of the slide remaining continuously in contact with the wedge surface 16, the flat bar 35 will engage in the recess 29 and come to rest against its delimiting surfaces 36 and 37, with the surface 26 still in contact with the wedge surface 16. In this position, the distance between the inner surface of the cross bar 30 and the face 31 of the forging 11 is greater than the height of the bar 33 used as connecting bar. Moreover, when the formwork panel 1 is erected, in which position the forming skin 3 normally extends vertically while the cross-strut 5 extends horizontally, the contact of the slide 20 with the flat bar 35 and the wedge surface 16 prevents the slide from tilting about an axis extending in parallel to the longitudinal direction of the cross-strut 5 so that in this position the bar 33 can be easily introduced into the inner space between the legs 22 of the slide without the need to hold the slide by hand. And when the bar 33 should hit the slide while being introduced, the latter also does not change its position in a manner to disturb the introduction or to render it even impossible. The flat bar 35 forms a detachable limit stop for the sliding movement of the slide 20 along the wedge surface 16. In the opposite direction of movement, i.e. when the slide 20 is moved towards the frame piece 4, the latter acts as a limit stop when no bar 33 is present.

At the side of the forging 11 opposite the frame piece 4, a plate 38 is fastened to each of the side faces of the cross-strut 5 extending vertically to the forming skin 3. The plates 38 comprise a raised edge 39 extending essentially vertically to the plane of the side faces 13. The two plates 38 could also be fastened directly to the side faces 13 and need not necessarily extend beyond the rear side 10 of the cross-strut 5. However, in the embodiment shown, the cross bar 40 forms an integral part of the two plates 38, which means that the plates 38 and the cross bar 40 are formed by bending in one piece, in order to facilitate the production. The cross bar 40 is in contact with the rear side 10 of the cross-strut 5. The distance between the end of the raised edge 39 facing the forging 11 and the rear side 10 of the cross-strut 5 is very small and increases later on, as can be seen in FIG. 3. In its end portion 41 opposite the forging 11, the raised rim 39 extends at a small angle only relative to the longitudinal direction of the cross-strut 5. In this area 41 of the cross-strut, the distance between the raised edge 39 and the cross bar 40 is such that when the slide is not needed for tensioning a bar 33 and when formwork panels are to be stacked, the slide can be clamped in position by means of its projections 24 which engage the edge 39, the wedging effect caused by the edge portion 41 which extends at a slight angle in relation to the longitudinal direction of the cross-strut 5 drawing the cross bar 30 of the slide 20 against the cross bar 40. To facilitate this clamping action, the level face 26 does not extend right to the right-hand end of the slide 20, as viewed in FIGS. 2 and 3, but changes over into a portion 45 where the distance to the cross bar 30 of the slide increases again, the two portions being separated by an edge 44. This arrangement facilitates the insertion of the slide in the edge portion 41 and the clamping of the slide 20 in its lowered inoperative position.

Duly allowing for the thickness of the cross bar 40 and the thickness of the cross bar 30 of the slide, the height of the cross-strut 5 is selected to ensure that in the lowered position, which is indicated in FIG. 3 by dash-dot lines, the outer face 50 of the slide opposite the forming skin 3 does not project beyond the rear side of the formwork panel 1 formed by wall sections of the frame pieces 4 opposite the forming skin 3, so that the slide will not hinder the stacking of the formwork panels.

The slide can be moved from its tensioning position shown in FIGS. 2 and 3 into its inoperative position by moving the slide 20 initially to the right—as viewed in FIGS. 2 and 3—so as to loosen the tension and to permit the bar 33 to be removed, and by lowering the slide on the cross-strut 5 thereafter towards the forming skin 3 into a position in which the flat bar 35 does not collide with the projections 24 of the slide. The projections 24 then get into engagement with the raised edge 39 of the plates 38 which guide the slide into its inoperative position when it is further moved to the right, as viewed in dotted lines in FIGS. 2 and 3.

So long as the flat bar 35 remains in position, the slide 20 cannot be removed from the formwork panel, which means that it is undetachably connected with the latter. If the slide 20 is to be removed, for instance for repair purposes, the flat bar 35 is removed, for instance by loosening a clamping sleeve. By displacing the slide 20 along the wedge surface 16, the slide 20 can thereupon be moved out of engagement with the forging 11 and, thus, removed from the formwork panel 1, without collision with the plates 38, because after the removal of the flat bar 35 a sufficient clearance exists between the end of the wedge surface 16 and the edge 39 serving as guide.

The outsides of the two legs 22 of the slide 20, i.e. the left and right ends of the side faces as viewed in FIGS. 2 and 3 are provided with one rib 55 each extending vertically to the forming plane. These ribs enable the slide 20 to be moved into the tightened and untightened position by means of a hammer. These ribs 55 or impact faces are arranged at a great distance from the neighbouring portions of the formwork panel 1 and reach—as can be seen in FIG. 4—close to the wedge surface formed by the projections 24 so that the slide 20 can be conveniently displaced by hammer blows without any collision with neighbouring parts. In the example shown, the slide 20 has a height of approx. 10 cm, measured vertically to the forming plane. FIGS. 2 to 4 being in correct scale, the other dimensions can be taken from the drawing.

Instead of the guide rail 39 projecting from the side wall of the cross-strut 5, a corresponding guide may be recessed in the side wall of the cross-strut, for engagement of the projections 24 of the slide 20. In this case, the slide 20 may have the form not of a U with open ends, but of a closed rectangle, provided the recessed guide opens into the upper face of the cross-strut.

In the lowered position, the upper inner face of the cross bar 30 of the slide 20 is in contact with the points 57 and 58 on the upper side of the cross-strut 5 or with an upper supporting face of the part 38 so that in this position the slide 20 is safely held at the 3 points 44, 57, 58 due to the wedging action of the inclined plane 45.

The faces 16 and 26 which are in contact with each other and which slide against each other during the tightening operation are inclined in relation to the surface 31 by the wedge angle 60 required to achieve the tensioning action, cf. the face 16 in FIG. 3. In addition, the faces 16 and 26 are inclined by an angle 61 in the direction perpendicular to the wedge angle 60. As can be seen in FIG. 4, this angle is approx. 10°. As can be further seen in FIG. 4, the direction of this inclination is such that when the wedge-type connection is tightened, the legs 22 of the slide 20 are drawn inwardly, or at least an inwardly directed force component acts on the leg ends.

What we claim is:

1. A formwork panel for use in a system for erecting concrete walls employing a plurality of formwork panels, adjacent panels being joined by a connecting bar, each said panel comprising a facing skin carried by a rectangular frame, having at least one cross-strut, said cross-strut being provided with oppositely formed projecting wedges extending laterally outward therefrom and a U-shaped slide member movably carried on said cross-strut, the legs of said U-shaped slide having oppositely extending inwardly directed projecting wedges said inwardly directed projecting wedges cooperating with the laterally extending projecting wedges to form a slidably engaging wedge coupling for removably securing said connecting bar to said cross strut within said U-shaped slide.

2. A formwork panel in accordance with claim 1, wherein the two lateral faces of the slide are provided with at least one rib each extending vertically in relation to the facing skin, which ribs serve as an impact surface for hammering purposes.

3. A formwork panel in accordance with claim 1, including means on said slide and cross-strut cooperating to retain the slide in a raised position in relation to said cross-strut, in which the clear height of the slide is greater than the height of the cross-section of said connecting bar, thereby facilitating the introduction of said bar into said slide.

4. A formwork panel in accordance with claim 3, wherein said means take the form of projections on said cross-strut adapted to engage the lower edge of said slide.

5. The formwork panel according to claim 1, wherein the height of said cross-strut is reduced relative to the corresponding height of the rectangular frame, by an amount corresponding substantially to the thickness of the central bar of the U-shaped slide member.

6. A formwork panel in accordance with claim 5, wherein the projections extending laterally from the cross-strut are integrally formed on a plate secured to the surface of the cross-strut facing away from the facing skin and that the slide is displaceable along the cross-strut out of engagement with the projections.

7. A formwork panel in accordance with claim 6, wherein the surfaces on said slide and on said laterally extending projections form cooperating inclined planes.

8. A formwork panel in accordance with claim 6, including retaining tabs provided on the side walls of the cross-strut extending vertically in relation to the facing skin and tabs coacting with the projections of the slide to retain the latter in a lowered position in which it does not project beyond the plane of the rectangular frame.

9. A formwork panel in accordance with claim 8 including guide means provided on the side walls of the cross-strut between the laterally extending projections and the retaining tabs for guiding the slide into its lowered position.

10. The formwork panel according to claim 8, wherein said laterally extending projections and said retaining tabs are spaced from each other a distance sufficient to permit removal of said slide from said cross strut, and means removably secured to said cross-strut are provided within said space to normally prevent removal of said slide.

11. A formwork panel for forming concrete walls having a forming skin carried on a steel frame comprising frame pieces extending along the edges of said forming skin and at least one wedge slide guided on a cross-strut of the said frame, which slide serves to press a bar spanning a joint between two neighboring formwork panels against frame pieces of the said formwork panel, said wedge slide having an essentially U-shaped cross-section and being disposed at least partly about said bar and legs of said wedge slide being shaped to coact with wedge parts mounted on the strut to form a wedge-type connection on suitable movement of said wedge slide relative to said cross-strut, the legs having wedge surfaces inclined in a direction perpendicular to the direction of movement of said wedge slide such as to insure that the legs are drawn inwardly on connection of said wedge slide, said bar and said cross strut.

12. A formwork panel in accordance with claim 11, wherein the inclination of the wedge surfaces in a direction perpendicular to the direction of movement of said wedge slide in 10°.

13. A formwork panel in accordance with claim 10, wherein the wedge surfaces are provided on projections extending inwardly from the legs of the slide.

14. A formwork panel in accordance with claim 13, wherein the inwardly directed projections of the legs of the slide coact with projections extending inwardly from the cross-strut of the frame.

15. A formwork panel in accordance with claim 13 wherein the cross-strut has one free end, that a clearance corresponding at least to the possible tensioning travel of the slide exists between the surface of the strut facing the forming skin and the surface of the forming skin facing the strut and that the inwardly directed projections of the legs of the slide coact with projections arranged at the bottom surface of the strut facing the forming skin to form an inclining wedge surface.

* * * * *